US008388257B2

(12) United States Patent
Redlberger

(10) Patent No.: US 8,388,257 B2
(45) Date of Patent: Mar. 5, 2013

(54) CONNECTING DEVICE FOR CONNECTING SEPARATING ELEMENTS FOR TRAFFIC AREAS

(75) Inventor: Mathias Redlberger, Modling (AT)

(73) Assignee: Rebloc GmbH, Gars am Kamp (AT)

( * ) Notice: Subject to any disclaimer, the term of this patent is extended or adjusted under 35 U.S.C. 154(b) by 0 days.

(21) Appl. No.: 13/130,432

(22) PCT Filed: Nov. 12, 2009

(86) PCT No.: PCT/AT2009/000430

§ 371 (c)(1),
(2), (4) Date: May 20, 2011

(87) PCT Pub. No.: WO2010/057232

PCT Pub. Date: May 27, 2010

(65) Prior Publication Data

US 2011/0229261 A1 Sep. 22, 2011

(30) Foreign Application Priority Data

Nov. 20, 2008 (AT) ..... A 1810/2008

(51) Int. Cl.
*E01F 15/08* (2006.01)
*F16B 17/00* (2006.01)

(52) U.S. Cl. ..... 404/6; 256/13.1

(58) Field of Classification Search ..... 404/6, 9; 256/1, 13.1

See application file for complete search history.

(56) References Cited

U.S. PATENT DOCUMENTS

| | | | | |
|---|---|---|---|---|
| 4,008,575 | A | 2/1977 | Gallagher | |
| 4,391,077 | A * | 7/1983 | Giess | 52/748.11 |
| 4,716,364 | A * | 12/1987 | Guilford et al. | 324/127 |
| 5,882,140 | A * | 3/1999 | Yodock et al. | 404/6 |
| D421,235 | S * | 2/2000 | Rausch | D10/113.3 |
| 7,445,403 | B2 * | 11/2008 | Williams et al. | 405/107 |
| 2004/0141807 | A1 * | 7/2004 | Yodock et al. | 404/6 |
| 2011/0076098 | A1 * | 3/2011 | Smith | 404/6 |

FOREIGN PATENT DOCUMENTS

| | | | |
|---|---|---|---|
| CH | 443 387 | A | 9/1967 |
| DE | 10 2007 006745 | A1 | 8/2008 |
| EP | 0 283 770 | A2 | 9/1988 |
| EP | 0 641 893 | A1 | 3/1995 |
| EP | 1 467 028 | A1 | 10/2004 |

OTHER PUBLICATIONS

International Search Report, dated Mar. 15, 2010, from corresponding PCT application.

* cited by examiner

*Primary Examiner* — Raymond W Addie
(74) *Attorney, Agent, or Firm* — Young & Thompson

(57) ABSTRACT

A connecting system (2) for connecting separating elements (1) for traffic areas has two connecting elements (3), each with two juxtaposed legs (5, 6). In each case, one leg (5) of a connecting element (3) is held between the legs (5, 6) of the other connecting element (3) in a positive-locking manner, as a leg (5) of the one connecting element (3) held between the legs (5, 6) of the other connecting element (3) has projections (9, 10) on both sides, which engage behind projections (9, 10, 11) disposed on the legs (5, 6) of the other connecting element (3). The legs (5, 6) of the two connecting elements (3) interlock with their projections (9, 10, 11) in hook form. In this way, the legs (5, 6) are not pushed apart when there is a tensile force acting on the connecting elements (3), but instead are held together or pushed towards one another.

20 Claims, 5 Drawing Sheets

CONNECTING DEVICE FOR CONNECTING SEPARATING ELEMENTS FOR TRAFFIC AREAS

Figure 1:
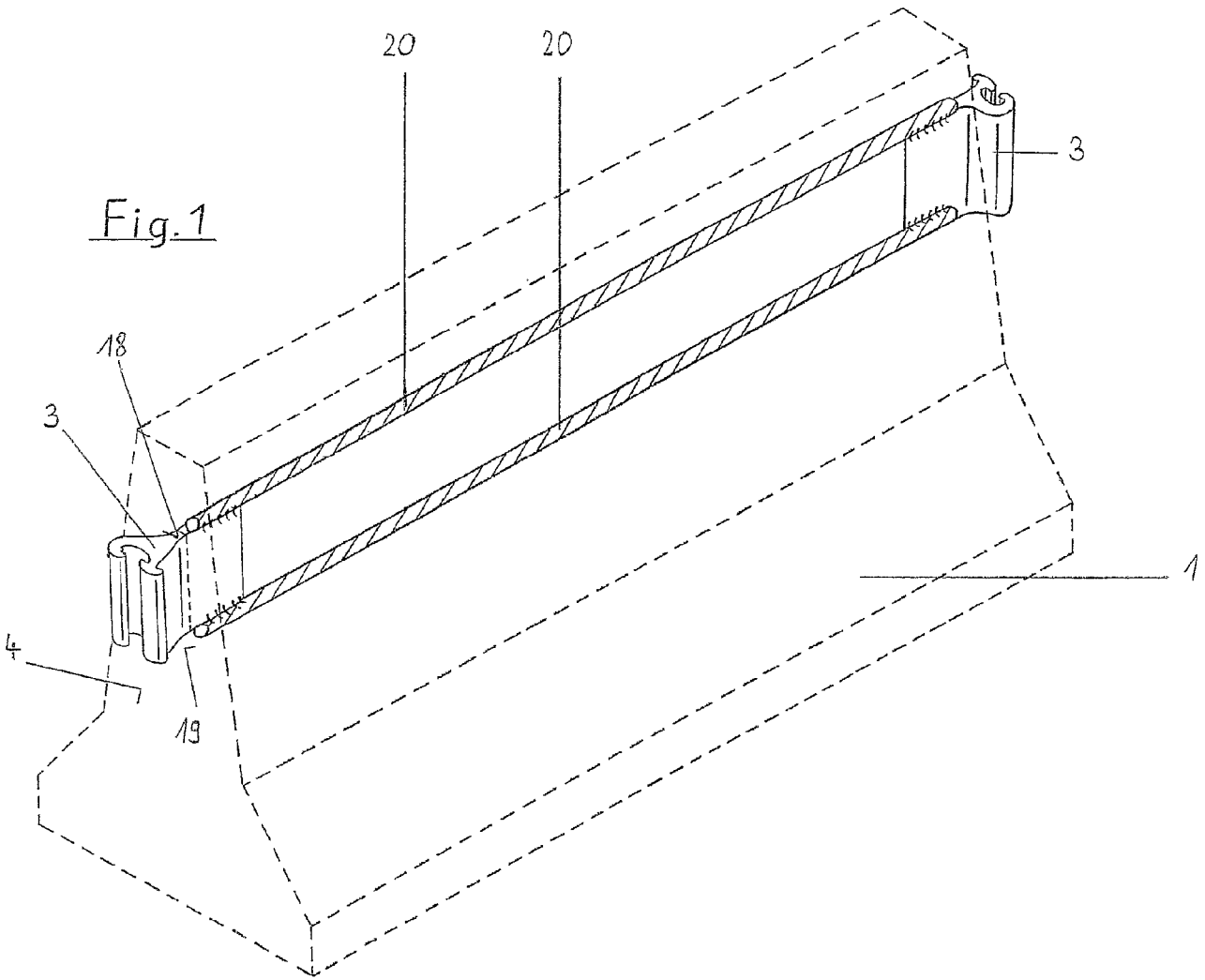

The invention relates to a connecting system for connecting separating elements for traffic areas with two connecting elements, each of which exhibits at least two juxtaposed legs, wherein in each case at least one leg of a connecting element is held between the legs of the other connecting element in a positive-locking manner, as a leg of the one connecting element held between the legs of the other connecting element has projections on both sides, which engage behind projections disposed on the legs of the other connecting element.

The invention further relates to a separating element for traffic areas, which is preferably made from concrete and has connecting elements on the end faces, with which it can be connected to an adjacent separating element.

A connecting system and a separating element of this type are disclosed in CH 443387 A and EP 1 467 028 A, for example. However, just as with many other known connecting systems, the systems described here have the disadvantage that they do not offer an adequate guarantee against pulling apart. The reason for this is that the connecting elements or else their legs lie against one another on wedge surfaces, which are disposed such that the legs of the connecting elements are pushed apart when, as a result of a collision between a vehicle and the separating elements connected to one another by a connecting system, a force is exerted that pulls the connecting elements apart. Although the legs are at least partly supported at the sides by concrete in some structural variants, in order to prevent a leg from bending away, this is only actually possible to a very limited extent, since the concrete in this corner area breaks off very easily.

The problem addressed by the invention is therefore one of creating a connecting system of the type mentioned above and a separating element equipped with connecting systems of this type, whereby the risk of these pulling apart during a vehicle collision is lower.

This problem is solved with a connecting system of the type mentioned above, in that the legs of the two connecting elements interlock with their projections in hook form.

With a separating element of the type mentioned above, this problem is solved in that it is designed with a connecting system such as that described above.

The connecting system according to the invention makes it possible for the legs not to be pushed apart by the hook-shaped connecting area when a tensile force acts on the connecting elements, but instead to be held together or pushed towards one another. A further consequence of this is that the bending moments acting on the legs are smaller, so that the legs do not require such a solid design as in the state of the art. Instead, bending forces now act on the projections, although these can be absorbed with a significantly lower material expenditure, since the bending moments are considerably smaller, due to the markedly shorter projections. Furthermore, shear stresses occur close to the projections, which are also far easier to control than the large bending moments acting on the legs in the state of the art.

Preferred embodiments of the connecting system according to the invention are the subject-matter of the dependent claims.

Other features and benefits of the connecting system according to the invention and the separating elements according to the invention result from the following description of preferred embodiments of the invention.

Figure 2:
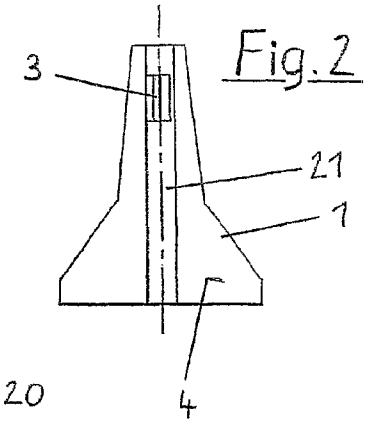
Figure 3:
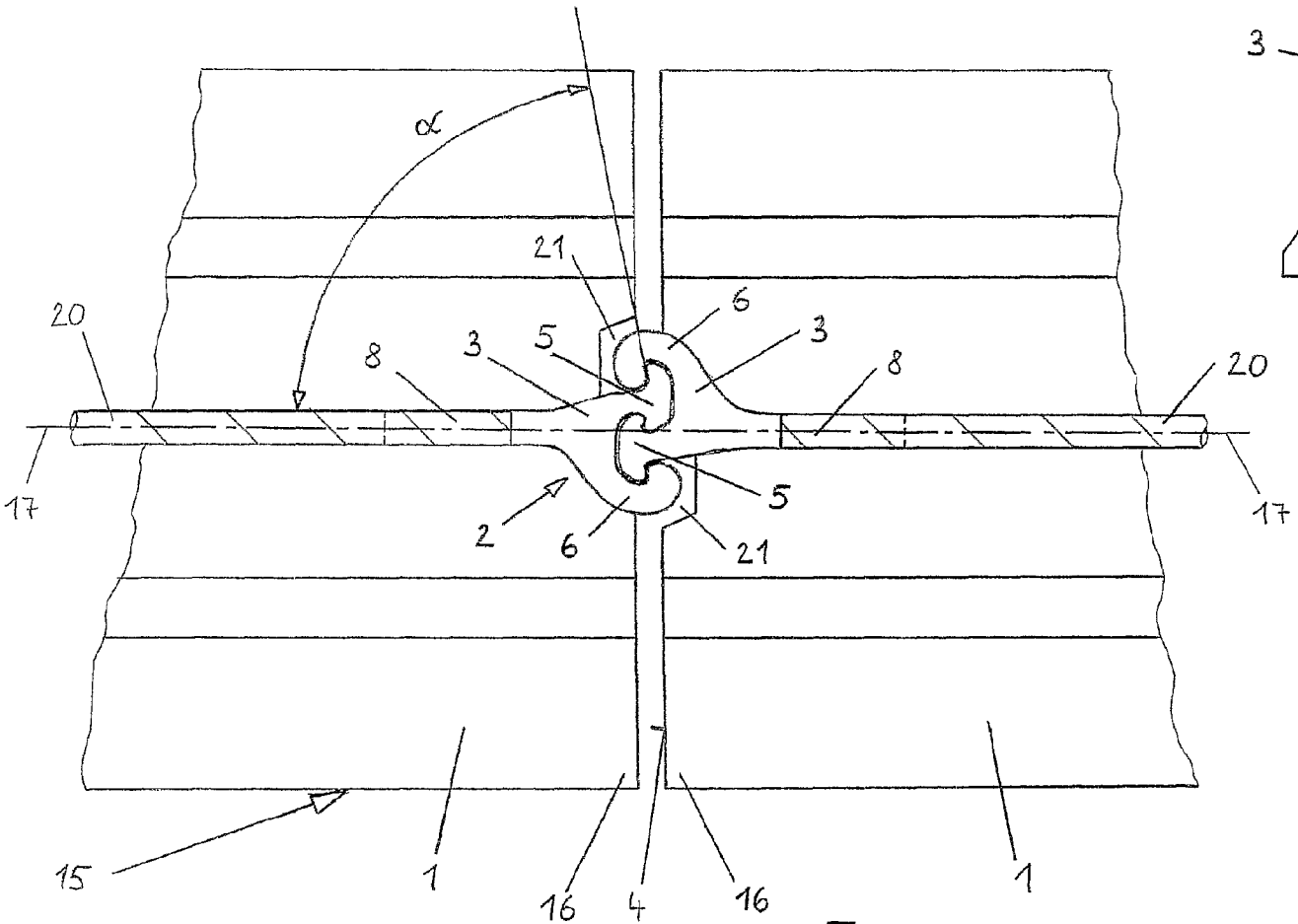
Figure 5:
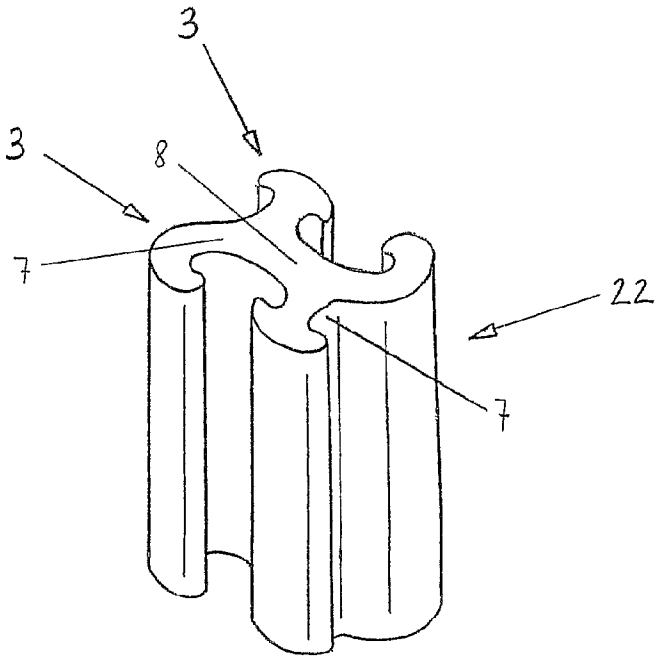
Figure 4:
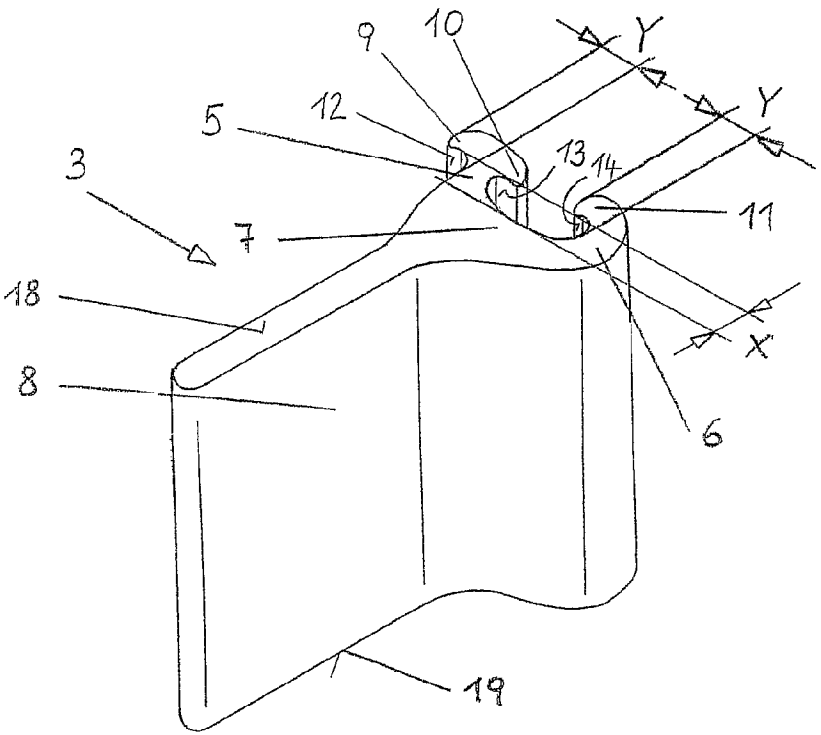
Figure 7:
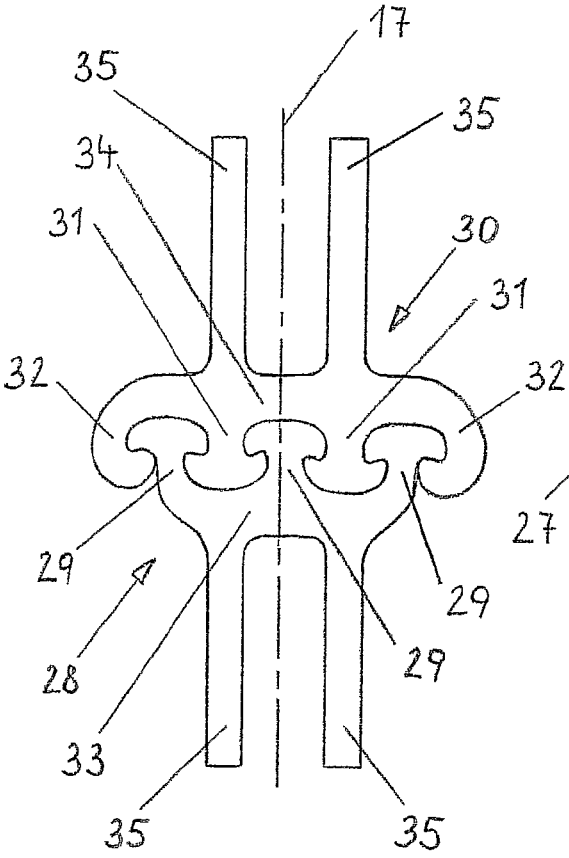
Figure 6:
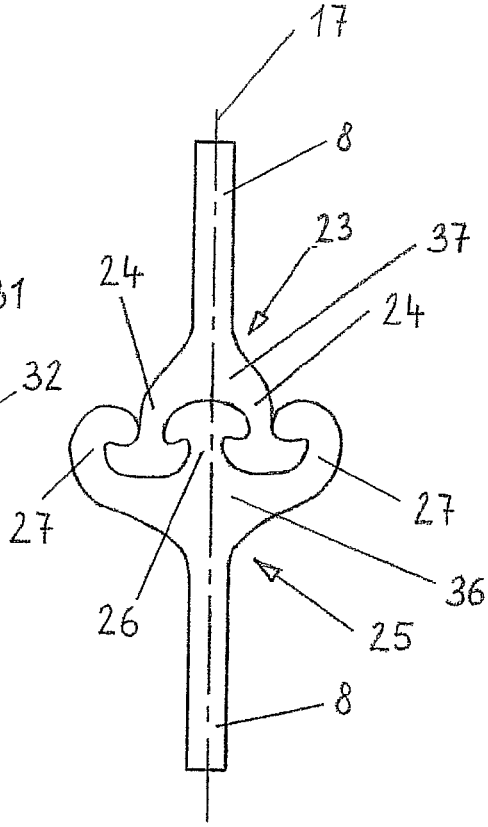
Figure 8:
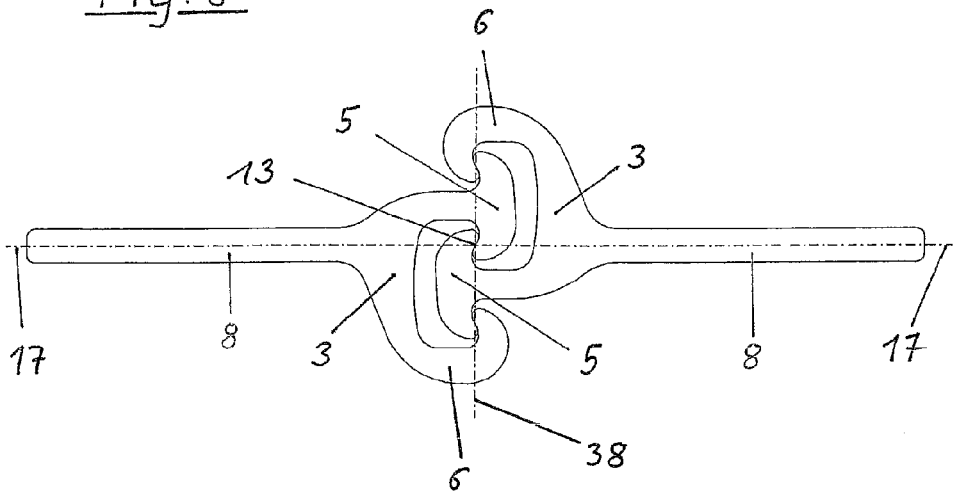
Figure 9:
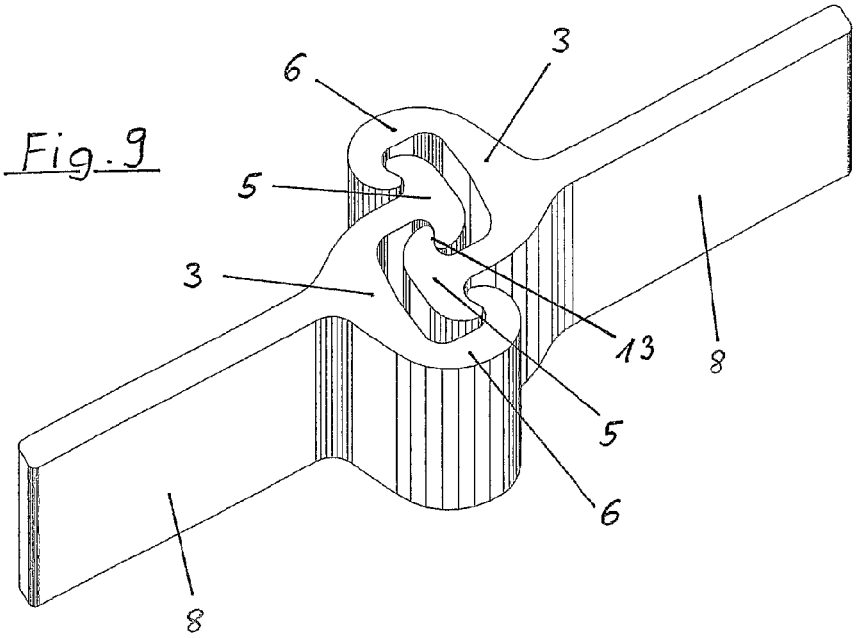

In the figures:

FIG. 1 shows a separating element according to the invention in diagonal section, FIG. 2 shows an end face of the separating element in FIG. 1, FIG. 3 shows a top view of the connecting area of two separating elements according to the invention, FIG. 4 shows a connecting element according to the invention in diagonal cross-section, FIG. 5 shows a coupling element made up of two connecting elements according to the invention, FIG. 6 shows a second embodiment of a connecting system according to the invention, FIG. 7 shows a third embodiment of a connecting system according to the invention, FIG. 8 shows a fourth embodiment of a connecting system according to the invention as a top view, which is similar to that in FIGS. 3 and 4 and FIG. 9 shows the connecting element from FIG. 8 in diagonal section.

A separating element according to the invention is illustrated in FIG. 1, which can be used as known per se with additional separating elements 1 to divide not only traffic areas, but also any other areas. If several juxtaposed separating elements 1 are connected to one another, they can also be used as containment systems, either between traffic lanes or at the edge of the road.

A connecting system 2 according to the invention is used to connect juxtaposed separating elements 1, said system comprising two identical connecting elements 3 in the embodiment shown in FIGS. 1 to 4. These connecting elements 3 are disposed on end faces 4 of the separating elements 1, wherein the connecting elements 3 disposed on opposite end faces 4 are twisted 180° around a horizontal axis, so that they assume the position illustrated in FIG. 3.

The connecting elements 3 depicted in FIGS. 1 to 4 have two legs 5 and 6, which are connected by a bar 7 to a plate-shaped support 8. One leg 5 has two projections 9 and 10 on its end facing away from the support 8, producing a roughly T-shaped cross-section overall. The second leg 6 has only one projection 11 on its end facing away from the support 8, which is turned towards the other leg 5, so that the leg 6 with its projection 11 exhibits a roughly L-shaped cross-section overall.

The projections 9, 10 and 11 have contact surfaces 12, 13, 14 facing the support 8, which are aligned at an angle $\alpha$ of less than 90° to a centre plane 17 of the support 8. Angle $\alpha$ is preferably between 60° and 95°, ideally between 80° and 90°. In this way, the projections 9, 10, 11 are disposed in hook form on the legs 5, 6.

If, as illustrated in FIG. 3, two connecting elements 3 are engaged in a positive-locking manner, the legs 5, 6 with their projections 9, 10, 11 hook onto one another. If, for instance, a vehicle hits a separating element 1 in the direction indicated by the arrow 15, the separating elements 1 connected to one another with the aid of the connecting system 2 initially move so far that they abut one another close to their corners 16. In a further sequence, the two corners 16 represent a rotational point, around which the separating elements can turn, if the collision force caused by the vehicle acts further on one of the two separating elements 1. In this way, the connecting system 2 is subject to a tensile force, which acts on the connecting system 2 predominantly in the direction of the plane 17, on which the support 8 lies. This tensile force attempts to pull out the legs 5 of the connecting elements 3 between the legs 5 and 6 of the other connecting element 3 in each case. This requires the legs 5, 6 to be bent to the side while at the same time the transitions between the projections 9, 10, 11 and the legs 5, 6 are exposed to a combined bending and shear force. Because the contact surfaces 12, 13, 14 are inclined at any angle of less than 90° to the direction of tension, the legs 5, 6 with their projections 9, 10, 11 hook into one another, so that a greater bending moment only occurs on the legs 5, 6 when the projections 9, 10, 11 are so widely deformed that the angle $\alpha$ of the contact surface 12, 13, 14 is equal to or greater than 90°.

Since the legs 5, 6 with their projections 9, 10, 11 can be very solid in design (while at the same time requiring a relatively small amount of material, due to the shortness of the legs 5, 6 and the projections 9, 10, 11), a significant part of the deformation force and deformation energy may be absorbed by the projections 9, 10, 11 or their connection to the legs 5, 6 before said legs 5, 6 are noticeably bent. Since the legs 5, 6, as the drawings show, may likewise be relatively short and solid, at the same time requiring a relatively small amount of material, these also demonstrate a very high bending resistance and are capable of withstanding high transverse forces.

In summary, this connecting element 3 design creates a connecting system 2, which exhibits a very high resistance to the connecting elements 3 being pulled apart in the event of a vehicle collision.

The supports 8 are connected to the legs 5 and 6 by bars 7. So that the load or distribution of forces acting on the connecting elements 3 is as symmetrical as possible, the supports 8 are disposed at the bars 7, such that their centre plane 17 lies close to the contact surfaces 13 of the two legs 5 lying in the centre of the connecting system 2.

The legs 5, 6 and their projections 9, 10, 11 are designed with sharply rounded edges and corners, so that the connecting elements 3 can be easily pushed into one another. Moreover, this makes them easier to manufacture and reduces mechanical stress close to the corners in the event of a vehicle colliding with a separating element 1. The length ratios of the legs 5, 6 and the projections 9, 10, 11 are preferably chosen in such a way that the ratio of the length X of the legs 5, 6 and the length Y of the projections 9, 10, 11 lies between 0.5 and 2.0.

As shown in FIGS. 1 and 4, connecting bars 20 are attached, preferably welded, to the top 18 and bottom 19 of the supports 8. The connecting bars 20 may be made from high yield steel customarily used in the building industry, for example, and connect a connecting element 3 on an end face 4 of a separating element 1 to the other connecting element 3 on the other end face 4. It is also conceivable, however, that the connecting bars 20 do not continue from one connecting element 3 to the other, but end inside the separating element 1 after a certain length. These connecting bars 20 may of course also be disposed in twos or multiples on the side surfaces of the supports 8.

It can also be seen from FIGS. 1 to 3 that vertical grooves 21 run on the end face 4 close to the connecting elements 3, which create space for the leg 6 of the connecting element 3 disposed on the adjacent separating element 1.

FIG. 5 depicts a coupling element 22, in which two connecting elements 3 are directly connected to one another. In other words, they are either connected to one another directly following their bars 7 or via a short supporting part 8. These types of coupling elements may be used to create a slightly larger gap between two separating elements 1, so that separating elements 1 can be assembled more easily in smaller radius curves, for instance, than would be possible with directly interconnected separating elements.

In the case of the exemplary embodiment shown in FIG. 6, a connecting element 23 exhibits two T-shaped legs designed in the same way as the leg 5 in the exemplary embodiment according to FIGS. 1 to 4. The second connecting element 25 displays a middle leg 26 and two outer legs 27. The middle leg 26 is once again T-shaped like the middle leg 5 and the outer legs 27 are L-shaped in the same way as the leg 6 in the embodiment shown in FIGS. 1 to 4. The advantage of this embodiment is firstly that the connecting elements 23, 25 are completely symmetrical in relation to the centre plane 17, which lies on the plane of the supports 8, and, secondly, that there is now a total of three legs 24, 26 having a T-shaped cross-section in conjunction with their projections, which facilitates symmetrical loading of the legs 24, 26 and distributes the load over a greater number of legs 24, 46, 27 and also a greater number of projections.

The exemplary embodiment shown in FIG. 7 represents an even stronger embodiment in this respect, in which a connecting element 28 has three T-shaped legs 29. Corresponding to the connecting element 25 in FIG. 6, the second connecting element 30 has two central, T-shaped legs 31 and two outer, L-shaped legs 32. In this embodiment, there are two supports 35 disposed on each of the bars 33 and 34 connecting the legs 29, 31 and 32, so that the connecting forces that can be transferred to a greater extent with this embodiment can be introduced into the separating element 1 between the two connecting elements 28 and 30.

A further embodiment of a connecting system according to the invention is depicted in FIGS. 8 and 9, which is similar to the embodiment depicted in FIGS. 1 to 4, wherein the space provided between the legs 5 and 6 and the connecting element 3 to hold the leg 5 with the projections 10, 11 is slightly larger, to enable the connecting elements to be hooked in more easily. FIG. 8 shows particularly clearly that the connecting area between the projections 10 of the legs 5 in the form of contact surfaces 13 lies precisely in the extension of the centre planes 17 of the supports 8, so that the load or distribution of forces acting on the connecting elements 3 is as symmetrical as possible. Furthermore, in this preferred embodiment of the invention, all contact areas lie between the surfaces 12, 13, 14 of the projections 9, 10, 11 of the legs 5, 6 on a plane 38, which lies at right angles to the planes 17 of the supports 8.

The invention claimed is:

1. Separating elements for traffic areas, comprising:

first and second separating elements, each of the first and second separating element comprised of i) a concrete construction traffic element (1) having a base configured for placement on ground, a top, a length, a centerline along the length, and two end faces (4), and a generally triangular cross-section from the base to the top, the concrete construction traffic element configured for collision from a vehicle, including an automobile; and ii) a connecting system comprised of first and second connecting elements with a support therebetween, the first connecting element (3; 23, 25; 28, 30) located on a first of the end faces (4), the second connecting element (3; 23, 25; 28, 30) located on a second of the end faces (4), the first and second connecting elements (3; 23; 25; 28; 30) each comprising a bar (7; 33, 34; 36, 37) connecting two juxtaposed first and second legs (5, 6; 24, 26, 27, 29, 31, 32), the support (8) disposed within and extending between the two end faces (4) of the concrete construction traffic element (1), the support (8) connecting an end of the bar of the first connecting element with an end of the bar of the second connecting element, the support (8) defining a longitudinal centerline of the connecting system, each of the first legs comprising a single hook projection (11) extending toward the longitudinal centerline of the connecting system, each of the second legs comprising i) a first hook projection (10) extending toward the longitudinal centerline of the connecting system, and ii) a second hook projection (9) extending away from the longitudinal centerline of the connecting system, wherein, the first connecting element of the first separating element is arranged to be connected with an adjacent second connecting element of the second separating element in a positive-locking manner with i) the first hook projection (10) of the first connecting element engaged behind that the first hook projection (10) of the adjacent second connecting element, ii) the second hook projection (9) of the first connecting element engaged behind that the single hook projection (11) of the adjacent second connecting element, and iii) the single hook projection (11) of the first connecting element engaged behind the second hook projection (9) of the adjacent second connecting element, and in use, with the first connecting element of the first separating element connected with the adjacent second connecting element of the second separating element in the positive-locking manner, the longitudinal centerline of the connecting system of the first separating element and the longitudinal centerline of the connecting system of the second separating element together define a central plane (17), the central plane (17) extending through the supports (8) of the first and second separating elements, the first hook projection (10) of the first connecting element and the first hook projection (10) of the adjacent second connecting element.

2. The separating elements according to claim 1, wherein the projections (9, 10, 11) are disposed on ends of the legs (5, 6; 24, 26, 27; 29, 31, 32).

3. The separating elements according to claim 1, wherein each second leg (5; 24, 26; 29, 31) has a roughly T-shaped cross-section, each first leg (6; 27; 32) has a roughly L-shaped cross-section.

4. The separating elements according to claim 1, wherein the legs (5, 6; 24, 26, 27; 29, 31, 32) and the projections (9, 10, 11) have rounded corners and edges in the connecting area.

5. The separating elements according to claim 1, wherein the first hook projection (10) of the first connecting elements define a hook-shaped connecting area (10, 13) extending from the support (8).

6. The separating elements according to claim 1, wherein the support (8, 35) is a plate.

7. The separating elements according to claim 1, wherein connecting bars (20) are disposed on the support (8, 35), the connecting bars running longitudinally between the two end faces.

8. The separating elements according to claim 7, wherein the connecting bars (20) are disposed, welded, on the top (18) and bottom (19) or the side surfaces of the support (8, 35).

9. The separating elements according to claim 8, wherein the connecting bars (20) exhibit at least one of i) bumps and ii) recesses on their surface.

10. The separating elements according to claim 1, wherein the first and second connecting elements (3) are directly connected to one another via the support (8).

11. The separating elements according to claim 1, wherein the projections (9, 10, 11) have contact surfaces (12, 13, 14) facing the support (8), which are aligned with the central plane (17) at an angle $\alpha$ of less than 90°.

12. The separating elements according to claim 11, wherein the angle $\alpha$ is between 60° and 95°.

13. The separating element according to claim 11, wherein the angle $\alpha$ is between 80° and 90°.

14. Separating elements for traffic areas, comprising:

first and second separating elements, each of the first and second separating element comprised of i) a concrete construction traffic element (1) having a base configured for placement on ground, a top, a length, a centerline along the length, and first and second end faces (4), the concrete construction traffic element configured for collision from an automobile; and ii) a connecting system comprised of first and second connecting elements with a support extending therebetween, the first and second connecting elements (3) respectively located on the first and second end faces, the first and second connecting elements (3) each comprising two connected juxtaposed first and second legs (5, 6), the support (8) disposed within and extending between the first and second end faces (4) and connecting the first connecting element with the second connecting element, the support (8) defining a longitudinal centerline of the connecting system, wherein, the first connecting element of the first separating element is configured to be connected, in a connecting area, with an adjacent second connecting element of the second separating element in a positive-locking manner with the first leg (5) of the first connecting element (3) held between the first and second legs (5, 6) of the second connecting element (3) by projections (10, 11) on the first and second legs (5, 6) of the second connecting element engaging behind corresponding projections (9, 10) on the first leg (5) of the first connecting element (3), the projections (9, 10, 11) interlocked in hook form, and in use, with the first connecting element of the first separating element connected with the adjacent second connecting element of the second separating element in the positive-locking manner, the longitudinal centerline of the connecting system of the first separating element and the longitudinal centerline of the connecting system of the second separating element together define a plane (17), the plane (17) extending through the supports (8) of the first and second separating elements, the first hook projection (10) of the first connecting element and the first hook projection (10) of the adjacent second connecting element.

15. The separating elements according to claim 14, wherein, the projections (9, 10, 11) are disposed on ends of the legs (5, 6), each second leg (5) has a T-shaped cross-section, and each first leg (6) has a L-shaped cross-section.

16. The separating elements according to claim 14, wherein the legs (5, 6) and the projections (9, 10, 11) have rounded corners and edges in the connecting area.

17. The separating elements according to claim 14, wherein the projections (9, 10,11) a single hook (11) on the first leg (6) and a double hook (9, 10) on the second leg (5).

18. The separating elements according to claim 14, wherein the support (8) is a plate.

19. The separating elements according to claim 18, wherein connecting bars (20) are disposed on the support (8), the connecting bars running longitudinally between the first and second end faces, the first and second connecting elements (3) are directly connected to one another via the support (8).

20. The separating elements according to claim 14, wherein the projections (9, 10, 11) have contact surfaces (12, 13, 14) facing the support (8), which contact surfaces are aligned with the plane (17) at an angle $\alpha$ of less than 90°.

* * * * *